US010962223B2

(12) United States Patent
Sakashita et al.

(10) Patent No.: US 10,962,223 B2
(45) Date of Patent: Mar. 30, 2021

(54) SOOT BLOWER

(71) Applicants: MITSUBISHI HITACHI POWER SYSTEMS, LTD., Yokohama (JP); MHI PLANT CORPORATION, Hiroshima (JP)

(72) Inventors: Gen Sakashita, Tokyo (JP); Yoshinori Koyama, Tokyo (JP); Takashi Yamamoto, Tokyo (JP); Kenta Haari, Kanagawa (JP); Yasunari Shibata, Kanagawa (JP); Masashi Kitada, Kanagawa (JP); Yasushi Okuda, Hiroshima (JP); Masami Tsuda, Hiroshima (JP); Satoru Murai, Hiroshima (JP)

(73) Assignees: MITSUBISHI POWER, LTD., Yokohama (JP); MHI PLANT CORPORATION, Hiroshima (JP)

( * ) Notice: Subject to any disclaimer, the term of this patent is extended or adjusted under 35 U.S.C. 154(b) by 385 days.

(21) Appl. No.: 16/084,355

(22) PCT Filed: Mar. 28, 2017

(86) PCT No.: PCT/JP2017/012714
§ 371 (c)(1),
(2) Date: Sep. 12, 2018

(87) PCT Pub. No.: WO2017/179420
PCT Pub. Date: Oct. 19, 2017

(65) Prior Publication Data

US 2019/0078779 A1 Mar. 14, 2019

(30) Foreign Application Priority Data

Apr. 12, 2016 (JP) ..... JP2016-079616

(51) Int. Cl.
*F23J 3/02* (2006.01)
*F28G 1/16* (2006.01)
(Continued)

(52) U.S. Cl.
CPC . *F23J 3/02* (2013.01); *F23J 3/00* (2013.01); *F23J 3/023* (2013.01); *F28G 1/16* (2013.01);
(Continued)

(58) Field of Classification Search
CPC ..... F23J 3/02; F23J 3/00; F23J 3/023; F23J 3/06; F23J 2700/001; F28G 15/003; F28G 15/02; F28G 1/16; F23D 2900/21007
See application file for complete search history.

(56) References Cited

U.S. PATENT DOCUMENTS 5,267,533 A 12/1993 Smith

FOREIGN PATENT DOCUMENTS

JP S62-112439 U 7/1987
JP H04-060279 A 2/1992
(Continued)

OTHER PUBLICATIONS

International Search Report dated Jun. 13, 2017, issued in counterpart application No. PCT/JP2017/012714, with English translation. (16 pages).

(Continued)

*Primary Examiner* — David Redding
(74) *Attorney, Agent, or Firm* — Westerman, Hattori, Daniels & Adrian, LLP

(57) ABSTRACT

In a soot blower, a heat transfer tube of a heat exchanger is arranged inside a pressure vessel, and gas for cleaning is injected toward the heat transfer tube from an injection pipe movable into and out of the pressure vessel. The soot blower includes a cylindrical casing provided to surround an insertion hole on the pressure vessel side into which the injection
(Continued)

pipe is inserted, to extend outside the pressure vessel, the injection pipe being inserted into an inside of the casing; a support part provided inside the casing to guide movement of the injection pipe and to ensure airtightness between the casing and the injection pipe; and a gas supplying device provided immediately close to the support part to generate a jet stream of gas in a portion of the injection pipe that projects to the pressure vessel side.

8 Claims, 7 Drawing Sheets

(51) Int. Cl.

| | |
|---|---|
| ***F23J 3/00*** | (2006.01) |
| ***F28G 15/00*** | (2006.01) |
| ***F28G 15/02*** | (2006.01) |
| *F23J 3/06* | (2006.01) |

(52) U.S. Cl.
CPC ..... *F28G 15/003* (2013.01); *F28G 15/02* (2013.01); *F23D 2900/21007* (2013.01); *F23J 3/06* (2013.01); *F23J 2700/001* (2013.01)

(56) References Cited

FOREIGN PATENT DOCUMENTS

| | | | |
|---|---|---|---|
| JP | H06-159650 | A | 6/1994 |
| JP | H08-028853 | A | 2/1996 |
| JP | 2003-269887 | A | 9/2003 |
| WO | 01/07804 | A1 | 2/2001 |

OTHER PUBLICATIONS

Office Action dated Feb. 6, 2018, issued in counterpart Japanese application No. 2016-079616, with English translation. (6 pages).

SOOT BLOWER

FIELD

The present invention relates to a soot blower that sprays gas for cleaning, such as steam, onto a heat transfer tube of a heat exchanger in a boiler, such as a gasifying furnace in which the pressure of furnace gas is maintained at a high pressure of several MPa, with an injection pipe inserted from the outside of the furnace, and cleans the heat transfer tube.

BACKGROUND

As typified by a coal fired boiler, in a boiler that uses solid coal as a fuel, when particulate unburnt carbon (char) mixed in combustion gas deposits on a heat transfer tube of a heat exchanger, the heat transfer performance of the heat transfer tube is lowered. Consequently, in the boiler in operation, it is necessary to clean the heat transfer tube several times a day for removing the char.

To clean the heat transfer tube, a soot blower provided with an injection pipe is used. The injection pipe is inserted into and retracted from a furnace to inject high-pressure steam or the like onto the surface of the heat transfer tube. For example, in the coal fired boiler, the pressure in the furnace is substantially equal to the atmospheric pressure and hence, when the injection pipe is inserted into and retracted from the furnace, it is unnecessary to pay particular attention to the leakage of the gas in the furnace. However, in an oil firing boiler, a gas fired boiler, or the like that uses oil, gas, or the like as a fuel, the pressure in the furnace is greater than the atmospheric pressure and hence, in particular, in the case of a gasifying furnace in which the furnace is maintained at several MPa, which is a high pressure, the furnace needs to have an airtight structure when the injection pipe is inserted into and extracted from the furnace by arranging various sealing materials including a gland packing in the passage of the injection pipe.

Conventionally, it is an object of a soot blower described in Patent Literature 1 to prevent char from leaking to the outside of a furnace, and prevent deposition of the char in the passage of an injection pipe that is inserted into and retracted from the furnace. The soot blower includes a connecting pipe that communicates with the furnace at an in-furnace insertion position of the injection pipe, connects a seal box to the connecting pipe by way of an insertion stop valve, and arranges the injection pipe by way of the seal box, the insertion stop valve, and the connecting pipe in such a manner that the injection pipe is able to be inserted into and retracted from the furnace, thus supplying deposit-removing gas to the connecting pipe. Furthermore, the soot blower supplies seal gas to the seal box.

Furthermore, conventionally, it is an object of a soot blower device described in Patent Literature 2 to securely prevent harmful or combustible flue gas from leaking from a furnace or a flue gas duct. In the soot blower device, a heat exchanger is arranged in a housing to which the flue gas is introduced; an injection pipe is arranged in an outer wall of the housing in a displaceable manner in an axial direction, the injection pipe being inserted into an insertion hole formed in the outer wall to inject seal gas toward the heat exchanger; the injection pipe is inserted into a casing fixed to the outer wall in such a manner that the casing externally surrounds the insertion hole; and an opening and closing valve having a valve port into which the injection pipe is inserted, a sealing material interposed between the outer peripheral face of the injection pipe and the inner peripheral face of the casing on the outer side than the opening and closing valve, and a gas supply hole that introduces the seal gas toward the sealing material are arranged in the casing.

CITATION LIST

Patent Literature

Patent Literature 1: Japanese Patent Application Laid-open No. 2003-269887

Patent Literature 2: Japanese Patent Application Laid-open No. H8-28853

SUMMARY

Technical Problem

Here, the injection pipe is inserted into the furnace and hence, the char adheres to the surface of the injection pipe. Furthermore, when the injection pipe is retracted from the furnace, the char adhering to the surface of the injection pipe is brought into the sealing material and is thus likely to cause the durability of the sealing material to be lowered.

In the invention of Patent Literature 1 mentioned above, the deposit-removing gas is supplied to the connecting pipe that communicates with the furnace at an in-furnace insertion position of the injection pipe. As described in Patent Literature 1, the pressure in the furnace is approximately 2.6 MPa and the pressure of the deposit-removing gas is approximately 2.7 MPa, and hence, although it is possible to prevent the deposition of the char in the passage of the injection pipe, which is inserted into and retracted from the furnace, the deposit-removing gas is insufficient to remove the char adhering to the surface of the injection pipe. Furthermore, in the invention of Patent Literature 1, the seal gas is supplied to the seal box. As described in Patent Literature 1, the pressure in the furnace is approximately 2.6 MPa and the pressure of the seal gas is approximately 2.7 MPa, and hence, the seal gas is insufficient to prevent the char adhering to the surface of the injection pipe from being brought into the sealing material.

Furthermore, in the invention of Patent Literature 2 mentioned above, the seal gas is supplied to the sealing material, and as described in Patent Literature 2, the pressure of the seal gas is 5 kg/cm (approximately 0.5 MPa), and hence, the seal gas is insufficient to prevent the char adhering to the surface of the injection pipe from being brought into the sealing material.

On the other hand, when the seal box or the connecting pipe that are described in Patent Literature 1, and respective cylindrical bodies of the casings that are described in Patent Literature 2 are connected to each other with the flanges, and a sealing member such as a vortex gasket is arranged between the flanges, a distance between the flanges facing each other changes due to the crushing margin of the gasket, and thus a difference in the distance causes axial center misalignment of the injection pipe. This axial center misalignment in the injection pipe may cause the injection pipe to be brought into contact with the heat transfer tube.

The present invention has been made to overcome such drawbacks, and it is an object of the present invention to provide a soot blower capable of preventing the char adhering to the surface of the injection pipe for soot-blowing from being brought into the sealing material. Furthermore, it is an object of the present invention to provide a soot blower capable of reducing the axial center misalignment of the injection pipe for soot-blowing.

Solution to Problem

To achieve the object, a soot blower of a first invention is a soot blower in which a heat transfer tube of a heat exchanger is arranged inside a pressure vessel, and gas for cleaning is injected toward the heat transfer tube from an injection pipe that is provided to be movable into and out of the pressure vessel. The soot blower includes a cylindrical casing provided to surround an insertion hole on the pressure vessel side into which the injection pipe is inserted, and to extend outside the pressure vessel, the injection pipe being inserted into an inside of the casing; a support part provided inside the casing to guide movement of the injection pipe and to ensure airtightness between the casing and the injection pipe; and a gas supplying device provided immediately close to the support part to generate a jet stream of gas in a portion of the injection pipe that projects on the pressure vessel side.

With this soot blower, the gas supplying device generates the jet stream of nitrogen gas in the portion of the support part from which the injection pipe projects to the pressure vessel side, thus blowing off the char adhering to the surface of the injection pipe by the gas injected by the injection pipe projecting from the support part to the pressure vessel side. Consequently, it is possible to prevent the char adhering to the surface of the injection pipe for soot-blowing from being brought into the sealing material of the support part. As a result, it is possible to enhance the advantageous effect of suppressing deterioration of the sealing material of the support part.

In the soot blower of a second invention according to the first invention, the support part includes a bearing to guide the movement of the injection pipe, and a sealing material that ensures airtightness between the casing and the injection pipe so that the bearing is arranged on the pressure vessel side of the sealing material, and the gas supplying device supplies gas to at least one of the pressure vessel side and the sealing material side with respect to the bearing.

The bearing of the support part, which guides the movement of the injection pipe, is low in airtightness as compared with the sealing material that ensures the airtightness. Consequently, there exists a tendency that the char adhering to the surface of the injection pipe easily passes through the bearing. With this soot blower, the first gas supplying device supplies nitrogen gas to at least one of the pressure vessel side or the sealing material side of the bearing. Accordingly, the jet stream is effectively generated around the injection pipe projecting to the pressure vessel side, in the distal end side of the bearing. Consequently, it is possible to blow off the char adhering to the surface of the injection pipe before the injection pipe passes through the bearing.

In the soot blower of a third invention according to the first or the second invention, the gas supplying device includes a discharge part configured to discharge gas to an outside of the casing.

With this soot blower, the gas inside the casing is discharged, thus safely performing an opening work of the casing at the time of maintenance for the support part or the like of the casing.

In the soot blower of a fourth invention according to any one of the first to third inventions, the casing includes a plurality of divided casings formed in a divided manner into a plurality of parts in a moving direction of the injection pipe, the divided casings have respective contact surfaces formed thereon, the contact surfaces facing and being brought into contact with each other in the moving direction of the injection pipe, a recessed portion being formed in one of the contact surfaces facing each other in an annular shape in a circumferential direction, the recessed portion housing a seal ring that is brought into contact with the other contact surface, and in the divided casings, the support part and a nozzle of the gas supplying device are provided.

With this soot blower, in the axial direction that is the moving direction of the injection pipe, the seal ring is housed in the recessed portion, and the respective contact surfaces of the divided casings are brought into contact with each other without sandwiching the seal ring therebetween, thus reducing the axial center misalignment, and ensuring the airtightness with the seal ring.

In the soot blower of a fifth invention according to the second invention, the casing includes a plurality of divided casings formed in a divided manner into a plurality of parts in a moving direction of the injection pipe, the divided casings have respective contact surfaces formed thereon, the contact surfaces facing and being brought into contact with each other in the moving direction of the injection pipe, a recessed portion being formed in one of the contact surfaces facing each other in an annular shape in a circumferential direction, the recessed portion housing a seal ring that is brought into contact with the other contact surface, and in the divided casings, the bearing and the sealing material of the support part and a nozzle of the gas supplying device are provided.

With this soot blower, in the axial direction that is the moving direction of the injection pipe, the seal ring is housed in the recessed portion, and the respective contact surfaces of the divided casings are brought into contact with each other without sandwiching the seal ring therebetween, thus reducing the axial center misalignment, and ensuring the airtightness with the seal ring. Furthermore, the bearing and the sealing material of the support part are arranged in the corresponding divided casings, thus easily performing the maintenance of each of the bearing and the sealing material.

In the soot blower of a sixth invention according to the fourth or the fifth invention, at least one of the divided casings is constituted as a spacer in which the support part is not provided.

With this soot blower, when the support part is detached at the time of maintenance, the divided casing constituted as the spacer is removed, thus ensuring a work space, and easily performing a maintenance work.

A soot blower of a seventh invention is a soot blower in which a heat transfer tube of a heat exchanger is arranged inside a pressure vessel, and gas for cleaning is injected toward the heat transfer tube from an injection pipe that is provided to be movable into and out of the pressure vessel. The soot blower includes a cylindrical casing provided to surround an insertion hole on the pressure vessel side into which the injection pipe is inserted, and to extend outside the pressure vessel, the injection pipe being inserted into an inside of the casing; and a support part provided inside the casing to guide movement of the injection pipe and to ensure airtightness between the casing and the injection pipe. The casing includes a plurality of divided casings formed in a divided manner into a plurality of parts in a moving direction of the injection pipe, the divided casings have respective contact surfaces formed thereon, the contact surfaces facing and being brought into contact with each other in the moving direction of the injection pipe, a recessed portion being formed in one of the contact surfaces facing each other in an annular shape in a circumferential direction, the recessed portion housing a seal ring that is brought into contact with the other contact surface, and in the divided casings, the support part is provided.

With this soot blower, in the axial direction that is the moving direction of the injection pipe, the seal ring is housed in the recessed portion, and the respective contact surfaces of the divided casings are brought into contact with each other without sandwiching the seal ring therebetween, thus reducing the axial center misalignment, and ensuring the airtightness with the seal ring.

In the soot blower of an eighth invention according to the seventh invention, the support part includes a bearing to guide the movement of the injection pipe, and a sealing material that ensures airtightness between the casing and the injection pipe so that the bearing is arranged on the pressure vessel side of the sealing material, and the bearing and the sealing material of the support part are provided in the corresponding divided casings.

With this soot blower, in the axial direction that is the moving direction of the injection pipe, the seal ring is housed in the recessed portion, and the respective contact surfaces of the divided casings are brought into contact with each other without sandwiching the seal ring therebetween, thus reducing the axial center misalignment, and ensuring the airtightness with the seal ring. Furthermore, the bearing and the sealing material of the support part are arranged in the corresponding divided casings, thus easily performing the maintenance of each of the bearing and a sealing material.

In the soot blower of a ninth invention according to the seventh or the eighth invention, at least one of the divided casings is constituted as a spacer in which the support part is not provided.

With this soot blower, when the support part is detached at the time of maintenance, the divided casing constituted as the spacer is removed, thus ensuring a work space, and easily performing a maintenance work.

Advantageous Effects of Invention

According to the present invention, it is possible to prevent the char adhering to the surface of the injection pipe for soot-blowing from being brought into the sealing material.

DESCRIPTION OF EMBODIMENTS

Hereinafter, embodiments according to the present invention are specifically explained based on drawings. Here, the present invention is not limited to these embodiments. Furthermore, constituents in the following embodiments include a part that can easily be effected by those skilled in the art, or parts substantially identical with each other.

Figure 1:
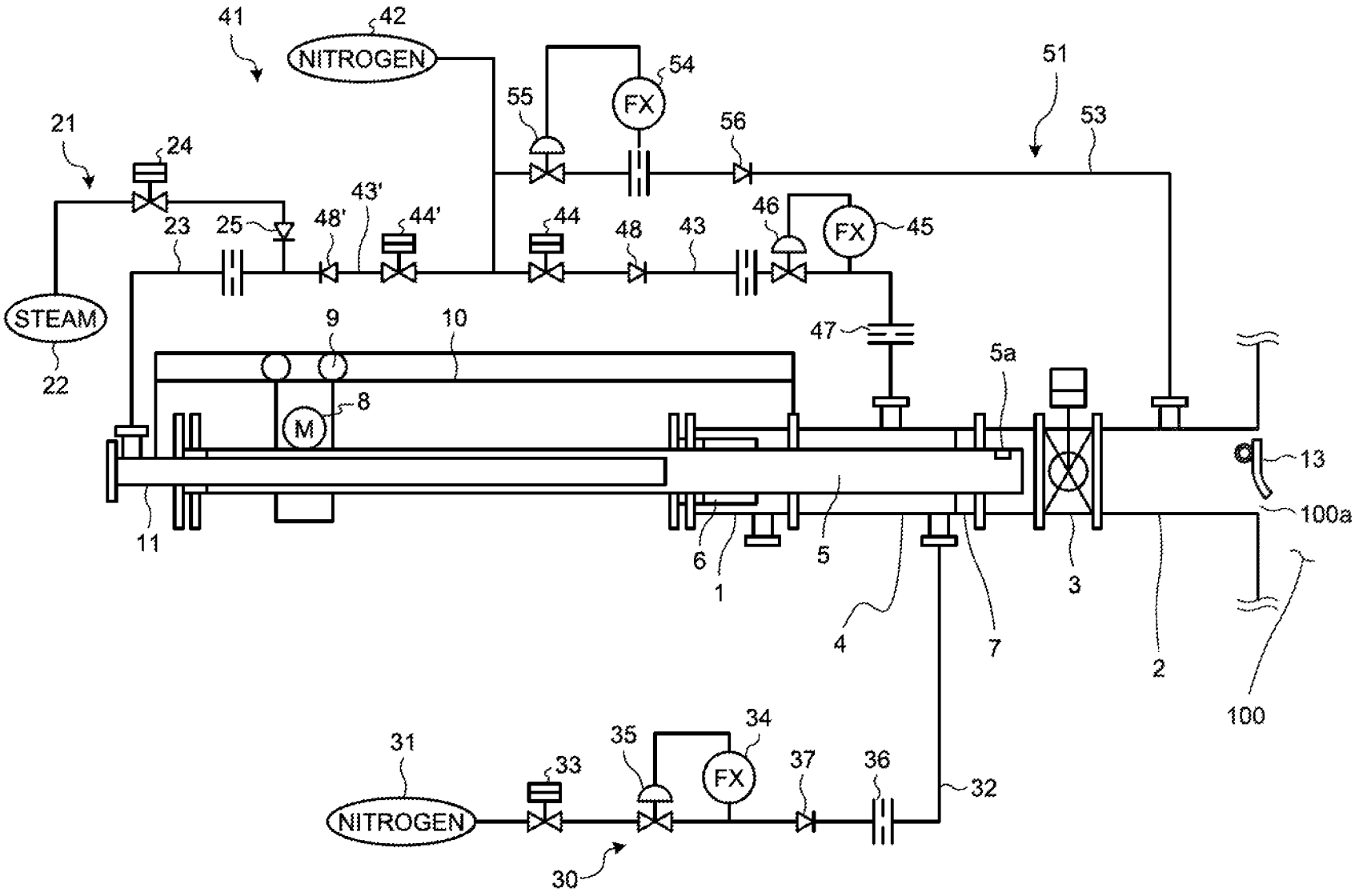
FIG. 1 is a schematic view of a soot blower according to an embodiment of the present invention.
Figure 2:
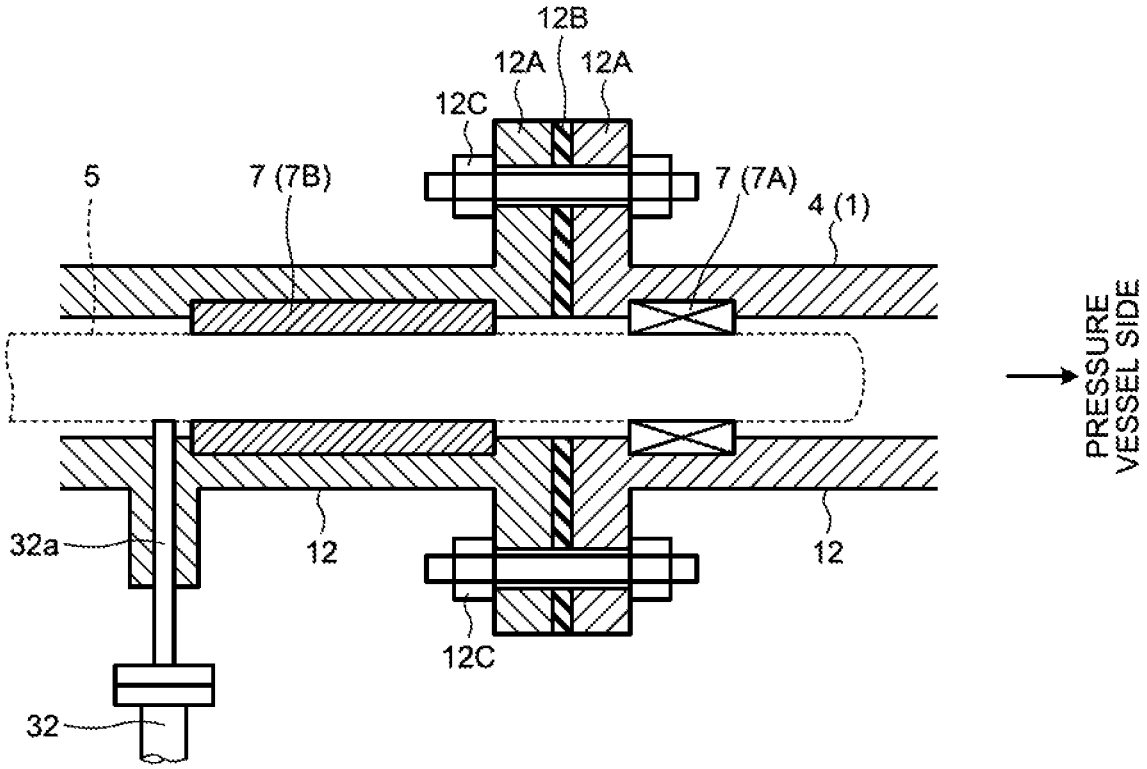
FIG. 2 is an essential-part enlarged view of the soot blower according to the embodiment of the present invention.

FIG. 1 is a schematic view of a soot blower according to the present embodiment. FIG. 2 is an essential-part enlarged view of the soot blower according to the present embodiment.

The soot blower of the present embodiment is provided to a pressure vessel 100 such as a typical gasifying furnace. Although not illustrated in the drawings, in the pressure vessel 100, a number of inner wall pipes are arranged in the inside thereof to define a gas passage, and a heat exchanging part constituted of a group (bank) of a large number of heat transfer tubes extending in the direction orthogonal to the flow of gas in a gas passage are arranged.

The soot blower has a cylindrical casing 1 connected with the pressure vessel 100 in such a manner that the casing surrounds an insertion hole 100*a* of the pressure vessel 100, and extends to the outside of the pressure vessel 100. The casing 1 has a connecting pipe 2, and a seal box 4.

The connecting pipe 2 is provided to communicate with the inside of the pressure vessel 100 from the insertion hole 100*a*. The setting position of the connecting pipe 2 corresponds to a position directly below the position in which the group of the heat transfer tubes is arranged as viewed in a horizontal direction, and the connecting pipe 2 is set to a position at which the connecting pipe 2 is capable of facing the group of the heat transfer tubes in close proximity to the group of the heat transfer tubes when an injection pipe 5 described later is inserted into the pressure vessel 100. A shutoff door 13 is arranged at the position of the insertion hole 100*a* of the pressure vessel 100, which is between the connecting pipe 2 and the pressure vessel 100, the shutoff door 13 being pivotally supported at the upper end portion thereof, normally shutting off the pressure vessel 100 and the connecting pipe 2, and being opened toward the inside of the pressure vessel 100 when pushed by the distal end of the injection pipe 5. Here, although not illustrated in the drawings, a skid member is arranged on the surface of the shutoff door 13 that faces the connecting pipe 2 in a position on the surface of the shutoff door 13 with which the distal end of the injection pipe 5 is brought into contact, thus preventing the injection pipe 5 and the shutoff door 13 from being brought into impulsive contact with each other, and from being frictionally joined with each other.

In the connecting pipe 2, an insertion stop valve 3 is arranged on the outward end of the connecting pipe 2 in the direction away from the pressure vessel 100. The insertion stop valve 3 is connected to the outer end of the connecting pipe 2 at one end thereof, and connected to the seal box 4 at the other end thereof. The insertion stop valve 3 is manually or automatically operated to establish the communication between the connecting pipe 2 and the seal boxes 4 or the interruption of the communication.

The seal box 4 is formed in a tubular shape so that the injection pipe 5 can be inserted into the seal box 4. One side of the seal box 4 that is connected to the insertion stop valve 3 is referred to as "distal end side", and the other side of the seal box 4 that is away from the insertion stop valve 3 is referred to as "rear end side".

The injection pipe 5 is formed in a cylindrical shape whose distal end side is closed, and has a nozzle 5*a* arranged on the distal end side thereof. The injection pipe 5 is configured such that the distal end side of the injection pipe 5 can move in a reciprocating manner over a predetermined stroke in the inside of the pressure vessel 100 through the insertion stop valve 3 and the connecting pipe 2 from the seal box 4. The injection pipe 5 has a wheel 9 arranged on the rear end side of the injection pipe 5, which is away from the pressure vessel 100, and the wheel 9 is driven by a motor 8, and moved along a guide track 10 arranged in parallel with the moving direction of the injection pipe 5, thus moving the injection pipe 5 in a reciprocating manner.

On the rear end side and the distal end side of the seal box 4, by a gland packing 6 and a support part 7, the movement of the injection pipe 5 is guided in moving in a reciprocating manner, and the airtightness between the injection pipe 5 and the seal boxes 4 is also ensured. The gland packing 6 is formed in an annular shape, arranged on the rear end side of the seal box 4 in the inside of the seal box 4, supports the injection pipe 5, which is moved in a reciprocating manner, on the inner face of the gland packing 6 in a sealing condition, and seals a gap between the injection pipe 5 and the inner wall of the seal box 4. The support part 7 has, as illustrated in FIG. 2, a bearing 7A guiding the movement of the injection pipe 5 by the inner side of the bearing 7A formed in an annular shape, and a sealing material 7B that ensures the airtightness between the seal box 4 and the injection pipe 5 by the inner side and the outer side of the sealing material 7B formed in an annular shape.

Here, the seal box 4 that constitutes the casing 1 has, as illustrated in FIG. 2, a plurality of divided casings 12 formed in a divided manner into a plurality of parts (two parts in FIG. 2) in the moving direction of the injection pipe 5. Each of the divided casings 12 has a flange 12A formed in a divided part, and the divided casings 12 are joined to each other with bolts 12C in a state that a sealing member, such as a vortex gasket 12B, is sandwiched between the flanges 12A facing each other. In the support part 7, the bearing 7A is arranged in the divided casing 12 arranged close to the pressure vessel 100, and the sealing material 7B is arranged in the divided casing 12 arranged away from the pressure vessel 100.

Furthermore, a guide pipe 11 fixed to a setting position located behind the injection pipe 5 is arranged on the rear side of the injection pipe 5. In the injection pipe 5, the distal-end side of the guide pipe 11 is inserted into the injection pipe 5 from the rear end side of the injection pipe 5, and the guide pipe 11 is fitted in the injection pipe 5 in a state that a gap between the injection pipe 5 and the guide pipe 11 is hermetically sealed so that the injection pipe 5 can be allowed to move with respect to the guide pipe 11. That is, the injection pipe 5 and the guide pipe 11 constitute a mutually extensible double pipe structure.

In the above-mentioned configuration, the soot blower has a steam feeding device 21, a first gas supplying device (gas supplying device) 30, a second gas supplying device 41, and a third gas supplying device 51.

The steam feeding device 21 connects a steam line 23 between the rear end side of the guide pipe 11 that projects from the rear end side of the injection pipe 5 and a steam source 22. The steam line 23 provides a shutoff valve 24 thereto. Consequently, when the shutoff valve 24 is opened, steam (gas) for cleaning is supplied to the guide pipe 11 and the injection pipe 5 from the steam source 22 by way of the steam line 23. Here, since the steam line 23 provides a check valve 25 arranged in the downstream position of the shutoff valve 24, it is impossible for the gas to flow backward to the steam source-22 side.

Here, although not illustrated in the drawings, a plurality of microswitches are arranged along the moving passage of the injection pipe 5, and the position of the injection pipe 5 to be moved in such a manner that the injection pipe 5 is inserted into and retracted from the inside of pressure vessel 100 is detected by the microswitches, thus acquiring an operation command of opening or closing the shutoff valve 24 that starts or stops steam injection in accordance with the position of the injection pipe 5.

The first gas supplying device 30 connects a first nitrogen gas line 32 between a portion immediately close to the support part 7 in the seal box 4 of the casing 1 and a first nitrogen gas supply source 31. The first nitrogen gas line 32 provides a shutoff valve 33 thereto. The first nitrogen gas line 32 provides thereto a regulating valve 35 that automatically performs opening adjustment thereof in response to the detection signal of a flow meter 34, and provides thereto an orifice 36 set to a certain throttle amount in the downstream position of the regulating valve 35. Accordingly, when the shutoff valve 33 is opened, nitrogen gas whose pressure is higher than the gas pressure inside the pressure vessel 100 is continuously supplied to a portion immediately close to the support part 7 from the first nitrogen gas supply source 31. Here, since the first nitrogen gas line 32 provides thereto a check valve 37 arranged in the downstream position of the regulating valve 35, it is impossible for the gas to flow backward to the first nitrogen gas supply source-31 side. Furthermore, the first nitrogen gas supply source 31 supplies the nitrogen gas for removing deposit such as char in a valve or a filter of the gasifying furnace, and the first gas supplying device 30 uses the first nitrogen gas supply source 31.

Here, the pressure difference between the pressure of the nitrogen gas supplied by the first gas supplying device 30 and the gas pressure inside the pressure vessel 100 is, for example, set within the range of 0.1 MPa to 1.2 MPa and, for example, when the gas pressure inside the pressure vessel 100 is 2.7 MPa, the nitrogen gas whose pressure is set within the range of 2.8 MPa to 3.9 MPa is supplied. Here, in adjusting the pressure of the nitrogen gas to be supplied, the first gas supplying device 30 may be provided with at least one of the regulating valve 35 and the orifice 36.

The pressure difference generates a jet stream of the nitrogen gas supplied to the portion immediately close to the support part 7, in the portion in which the injection pipe 5 projects to the pressure vessel 100 side of the support part 7.

The second gas supplying device 41 connects a second nitrogen gas line 43 between the seal box 4 of the casing 1 and a second nitrogen gas supply source 42 different from the first nitrogen gas supply source 31. The second nitrogen gas line 43 provides a shutoff valve 44 thereto. Furthermore, the second nitrogen gas line 43 provides thereto a regulating valve 46 that automatically performs opening adjustment thereof in response to the detection signal of a flow meter 45 on the downstream side of the shutoff valve 44, and provides thereto an orifice 47 set to a certain throttle amount in the downstream position of the regulating valve 46. Accordingly, when the shutoff valve 44 is opened, nitrogen gas whose pressure is slightly higher than the gas pressure inside the pressure vessel 100 is continuously supplied. Here, since the second nitrogen gas line 43 provides thereto a check valve 48 arranged in the downstream position of the shutoff valve 44, it is impossible for the gas to flow backward to the second nitrogen gas supply source-42 side. The pressures of the nitrogen gas supplied by the second gas supplying device 41 is, for example, 2.9 MPa, which is higher than the gas pressure inside the pressure vessel 100, which is set to 2.7 MPa, by about 0.2 MPa.

Furthermore, the second gas supplying device 41 provides thereto another second nitrogen gas line 43' that is branched from the second nitrogen gas line 43 at the upstream position of the shutoff valve 44, and communicably connected to the steam line 23. The second nitrogen gas line 43' provides thereto a shutoff valve 44', and a check valve 48' arranged in the downstream position of the shutoff valve 44'. Consequently, when the shutoff valve 24 of the steam feeding device 21 is closed, and the shutoff valve 44' is opened, nitrogen gas for removing char is supplied from the second nitrogen gas supply source 42 to the guide pipe 11 and the injection pipe 5 by way of the second nitrogen gas line 43' and the steam lines 23.

The third gas supplying device 51 provides thereto a third nitrogen gas line 53 between the upstream position of the shutoff valve 44 (shutoff valve 44') of the second nitrogen gas line 43 and the connecting pipe 2, which is the casing 1. The third nitrogen gas line 53 provides thereto a regulating valve 55 that automatically performs opening adjustment thereof in response to a detection signal of a flow meter 54. Accordingly, the nitrogen gas whose pressure is higher than the gas pressure inside the pressure vessel 100 is always supplied to the inside of the connecting pipe 2 from the second nitrogen gas supply source 42. Here, since the third nitrogen gas line 53 provides thereto a check valve 56 arranged in the downstream position of the regulating valve 55, it is impossible for the gas to flow backward to the second nitrogen gas supply source-42 side. The pressures of the nitrogen gas supplied by the third gas supplying device 51 is, for example, 2.9 MPa, which is higher than the gas pressure inside the pressure vessel 100, which is set to 2.7 MPa, by about 0.2 MPa.

In the soot blower of the present embodiment that is constituted as above, in a steady state in which the pressure vessel 100 functions as a gasifying furnace, the high-pressure gas of 2.7 MPa flows, for example, in the pressure vessel 100. In this case, the insertion stop valve 3 is closed, the injection pipe 5 is located at a retracted position illustrated in FIG. 2, and the shutoff valves 24, 44, and 44' are also closed. Furthermore, in the first nitrogen gas line 32 also, the shutoff valve 33 is closed in a steady state in which the pressure vessel 100 functions as a gasifying furnace. On the other hand, in the third nitrogen gas line 53, a shutoff valve is not arranged, and nitrogen gas whose pressure is adjusted by the regulating valve 55 and, for example, set to 2.9 MPa higher than the pressure of the high-pressure gas in the pressure vessel 100 is always supplied during the operation of the pressure vessel 100.

Furthermore, in cleaning the heat transfer tube at a frequency of about 3 to 4 times a day, the shutoff valve 44 is opened, and the nitrogen gas whose pressure is set to approximately 2.7 MPa is supplied, as seal gas, to the seal box 4 through the second nitrogen gas line 43. Subsequently, the insertion stop valve 3 is opened, the motor 8 is started, the injection pipe 5 is inserted into the pressure vessel 100 through the connecting pipe 2, the shutoff valve 24 is opened when the injection pipe 5 is located at a predetermined position to introduce steam into the injection pipe 5 through the steam line 23, the injection of the steam from the nozzle 5*a* is started, the injection of the steam is continuously performed until the injection pipe 5 is turned back at a predetermined position and returns to the injection start position, the shutoff valve 24 is closed at the position to which the injection pipe 5 is returned, and the injection of the steam is stopped. Here, when the injection pipe 5 is inserted into the pressure vessel 100 through the connecting pipe 2, the injection pipe 5 pushes open the shutoff door 13 arranged between the connecting pipe 2 and the pressure vessel 100 by the distal end thereof so as to move forward.

Here, slightly before the shutoff valve 24 is opened and the injection of steam is started, the shutoff valve 44' is temporarily opened at the stage where the nozzle 5*a* arranged on the distal end of the injection pipe 5 is inserted into the connecting pipe 2, nitrogen gas is supplied to the inside of the injection pipe 5 through the steam line 23 from the second nitrogen gas line 43', and the air or the like that is stayed in the injection pipe 5 is purged.

The cleaning operation of the heat transfer tube in the pressure vessel 100 is performed by steam injection in the period from starting the steam injection by the injection pipe 5 to stopping the steam injection, and the injection pipe 5 is continuously retracted from the pressure vessel 100 also after stopping the steam injection. Furthermore, the injection pipe 5 is moved out from the connecting pipe 2 and the insertion stop valve 3, and returned to the retracted position, the insertion stop valve 3 is returned to a closing position in accordance with the timing where the injection pipe 5 is retracted, the shutoff valve 44 is next closed, and the soot blower is returned to the original state that nitrogen gas is supplied to the connecting pipe 2 through the third nitrogen gas lines 53.

While nitrogen gas is supplied through the second nitrogen gas line 43 mentioned above; to be more specific, while the injection pipe 5 is moved so that the injection pipe 5 can be inserted into the pressure vessel 100, or the injection pipe 5 is retracted from the pressure vessel 100; or in both cases above, the shutoff valve 33 of the first gas supplying device 30 is opened. Accordingly, the nitrogen gas whose pressure is adjusted by the regulating valve 35, and set, for example, within the range from 2.8 MPa to 3.9 MPa, which is higher than the pressure of the high-pressure gas inside the pressure vessel 100, is supplied to the portion immediately close to the support part 7 through the first nitrogen gas line 32.

In this manner, the soot blower of the present embodiment, in which the heat transfer tube of the heat exchanger is arranged inside the pressure vessel 100, and the steam for cleaning is injected toward the heat transfer tube from the injection pipe 5 that is provided to be movable into and out of the pressure vessel 100, includes the cylindrical casing 1 provided to surround the insertion hole 100*a* on the pressure vessel 100 side into which the injection pipe 5 is inserted, and to extend outside the pressure vessel 100, the injection pipe 5 being inserted into the inside thereof; the support part 7 provided inside the casing 1 to guide the movement of the injection pipe 5 and to ensure the airtightness between the casing 1 and the injection pipe 5; and the first gas supplying device 30 provided immediately close to the support part 7 to generate the jet stream of gas (nitrogen gas) in a portion of the injection pipe 5 that projects on the pressure vessel 100.

With this soot blower, the first gas supplying device 30 generates the jet stream of nitrogen gas in the portion located on the pressure vessel 100 side of the support part 7 to which the injection pipe 5 projects, thus blowing off the char adhering to the surface of the injection pipe 5 by the gas injected by the injection pipe 5 projecting to the pressure vessel 100 side of the support part 7. Consequently, it is possible to prevent the char adhering to the surface of the injection pipe 5 for soot-blowing from being brought into the sealing material 7B of the support part 7. As a result, it is possible to enhance the advantageous effect of suppressing the development in deterioration of the sealing material 7B of the support part 7.

It is an object of the process of generating the jet stream of nitrogen gas by the first gas supplying device 30 in the portion located on the pressure vessel 100 side of the support part 7 to which the injection pipe 5 projects to remove the char adhering to the surface of the injection pipe 5, and the nitrogen gas is supplied only while the injection pipe 5 is being moved. This is because it is preferable to reduce the amount of nitrogen gas supply, and shorten the amount of time for supplying the nitrogen gas, in terms of suppressing the lowering of the production gas heat value of the gasifying furnace.

Here, in FIG. 2, the first gas supplying device 30 arranges a nozzle 32*a* to which the distal end of the first nitrogen gas line 32 is connected on the rear end side of the sealing material 7B of the support part 7 so that nitrogen gas can be supplied to a portion that is located immediately close to the support part 7, and located on the rear end side of the support part 7. In this case, the nitrogen gas supplied from the nozzle 32*a* passes through the minute clearance between the support part 7 and the injection pipe 5, thus generating a jet stream around the injection pipe 5 projecting to the pressure vessel 100 side of the support part 7. To be more specific, the nitrogen gas supplied from the nozzle 32*a* passes through the minute clearance between the sealing material 7B located on the rear end side of the support part 7 and the injection pipe 5, and further passes through the minute clearance between the bearing 7A located on the distal end side of the support part 7 and the injection pipe 5, thus generating the jet stream around the injection pipe 5 projecting to the pressure vessel 100 side of the support part 7. Consequently, the char adhering to the surface of the injection pipe 5 is blown off.

Figure 3:
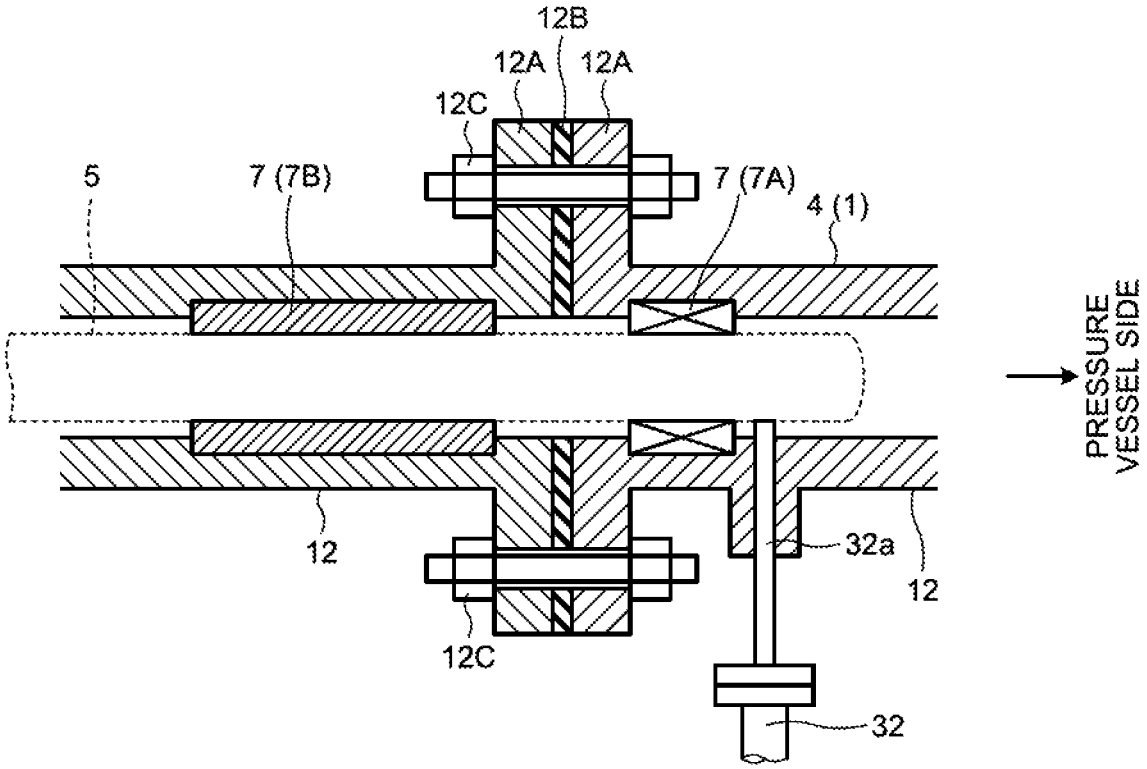
FIG. 3 is an essential-part enlarged view of another example of the soot blower according to the embodiment of the present invention.
Figure 4:
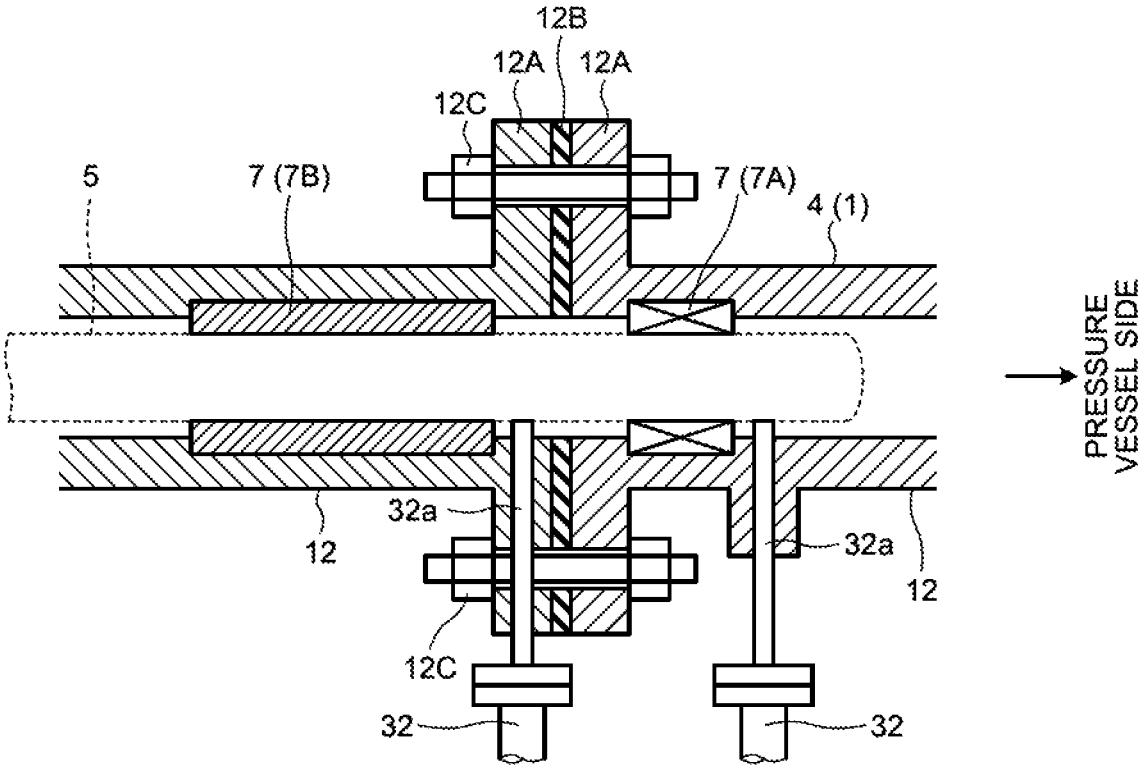
FIG. 4 is an essential-part enlarged view of still another example of the soot blower according to the embodiment of the present invention.

The arrangement of the nozzle 32*a* is not limited to the configuration mentioned above. FIG. 3 and FIG. 4 are essential-part enlarged views each of which illustrates another examples of the soot blower according to the present embodiment, each of the essential-part enlarged views illustrating a different arrangement of the nozzle 32*a*.

In the configuration illustrated in FIG. 3, the first gas supplying device 30 includes the nozzle 32*a* arranged in a portion that is located immediately close to the support part 7, and located on the distal-end side of the bearing 7A in the support part 7. In this case, the nitrogen gas supplied from the nozzle 32*a* directly generates a jet stream around the injection pipe 5 projecting to the pressure vessel 100 side of the support part 7. To be more specific, the nitrogen gas supplied from the nozzle 32*a* generates the jet stream around the injection pipe 5 projecting to the pressure vessel 100 side of the support part 7, on the distal-end side of the bearing 7A. Consequently, the char adhering to the surface of the injection pipe 5 is blown off.

In the configuration illustrated in FIG. 4, the first gas supplying device 30 arranges the nozzles 32*a* in respective portions that are located immediately close to the support part 7, and located on the rear end side and the distal end side of the bearing 7A in the support part 7. In this case, the nitrogen gas supplied from one of the nozzles 32*a* passes through the minute clearance between the bearing 7A and the injection pipe 5, thus generating a jet stream around the injection pipe 5 projecting to the pressure vessel 100 side of the support part 7. Furthermore, the nitrogen gas supplied from the other nozzle 32*a* generates a jet stream around the injection pipe 5 projecting to the pressure vessel 100 side of the support part 7, on the distal end side of the bearing 7A. Consequently, the char adhering to the surface of the injection pipe 5 is blown off.

In this manner, in the soot blower of the present embodiment, the support part 7 includes the bearing 7A to guide the movement of the injection pipe 5, and the sealing material 7B that ensures the airtightness between the casing 1 and the injection pipe 5, the bearing 7A is arranged on the pressure vessel 100 side of the sealing material 7B, and the first gas supplying device 30 supplies nitrogen gas to at least one of the pressure vessel 100 side and the sealing material 7B side with respect to the bearing 7A.

The bearing 7A of the support part 7, which guides the movement of the injection pipe 5, is low in airtightness as compared with the sealing material 7B that ensures the airtightness. Consequently, there exists a tendency that the char adhering to the surface of the injection pipe 5 easily passes through the bearing 7A. With this soot blower of the present embodiment, the first gas supplying device 30 supplies nitrogen gas to at least one of the pressure vessel 100 side and the sealing material 7B side of the bearing 7A. Accordingly, in a portion located on the distal end side of the bearing 7A, a jet stream is effectively generated around the injection pipe 5 projecting to the pressure vessel 100 side of the support part 7. Consequently, it is possible to blow off the char adhering to the surface of the injection pipe 5 before the injection pipe 5 passes through the bearing 7A.

Figure 5:
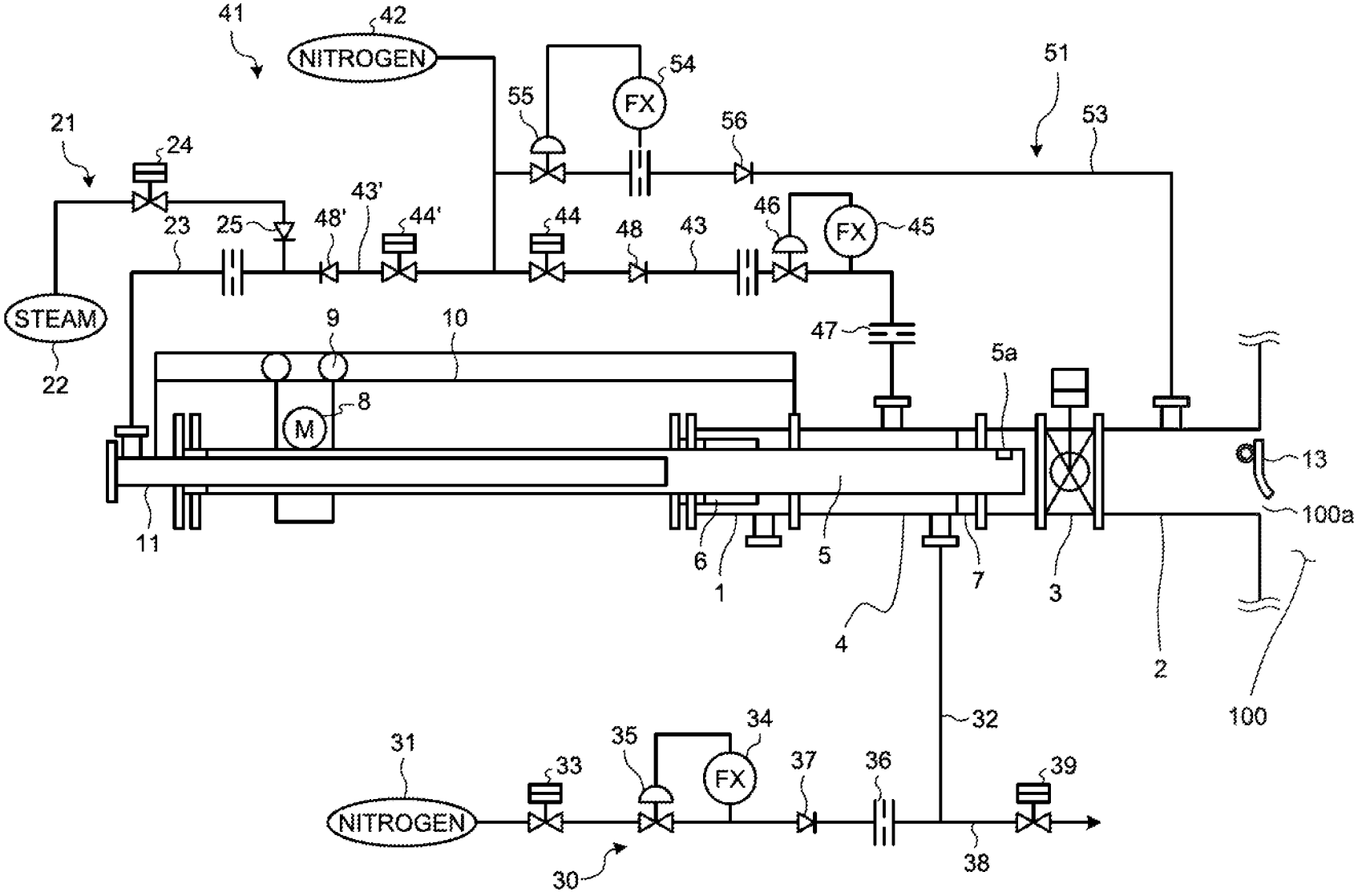
FIG. 5 is a schematic view of an additional example of the soot blower according to the embodiment of the present invention.

FIG. 5 is a schematic view of an additional example of the soot blower according to the present embodiment.

In the soot blower of the present embodiment, the first gas supplying device 30 has a discharge part that discharges nitrogen gas to the outside of the casing 1. The discharge part is, as illustrated in FIG. 5, constituted of a branch line 38 branched on the downstream side of the orifice 36 of the first nitrogen gas line 32, the branch line 38 being opened to the atmosphere, and a shutoff valve 39 arranged in the branch line 38.

That is, in the discharge part, the shutoff valve 39 is opened, thus discharging the nitrogen gas in the first nitrogen gas line 32 through the branch line 38. Consequently, the gas inside the casing 1 is discharged, thus safely performing an opening work of the casing 1 at the time of maintenance of the support part 7 or the like (the bearing 7A, the sealing material 7B, and the gland packing 6 of the support part 7) of the casing 1. To be more specific, when starting the maintenance, the pressure remaining in the insertion stop valve 3 and the support part 7 is securely released. Consequently, the gas inside the casing 1 is discharged by the discharge part, thus safely performing the opening work of the casing 1.

Figure 6:
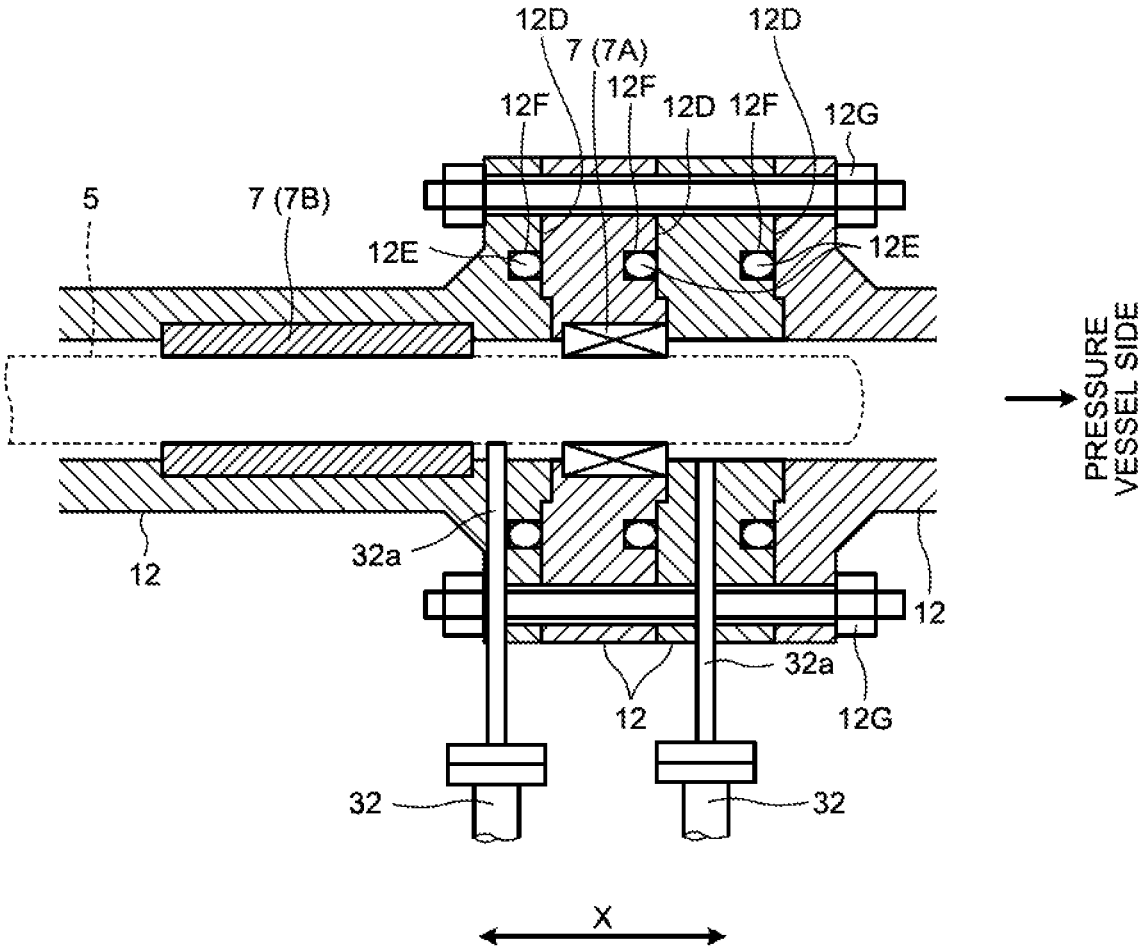
FIG. 6 is an essential-part enlarged view of still another example of the soot blower according to the embodiment of the present invention.
Figure 7:
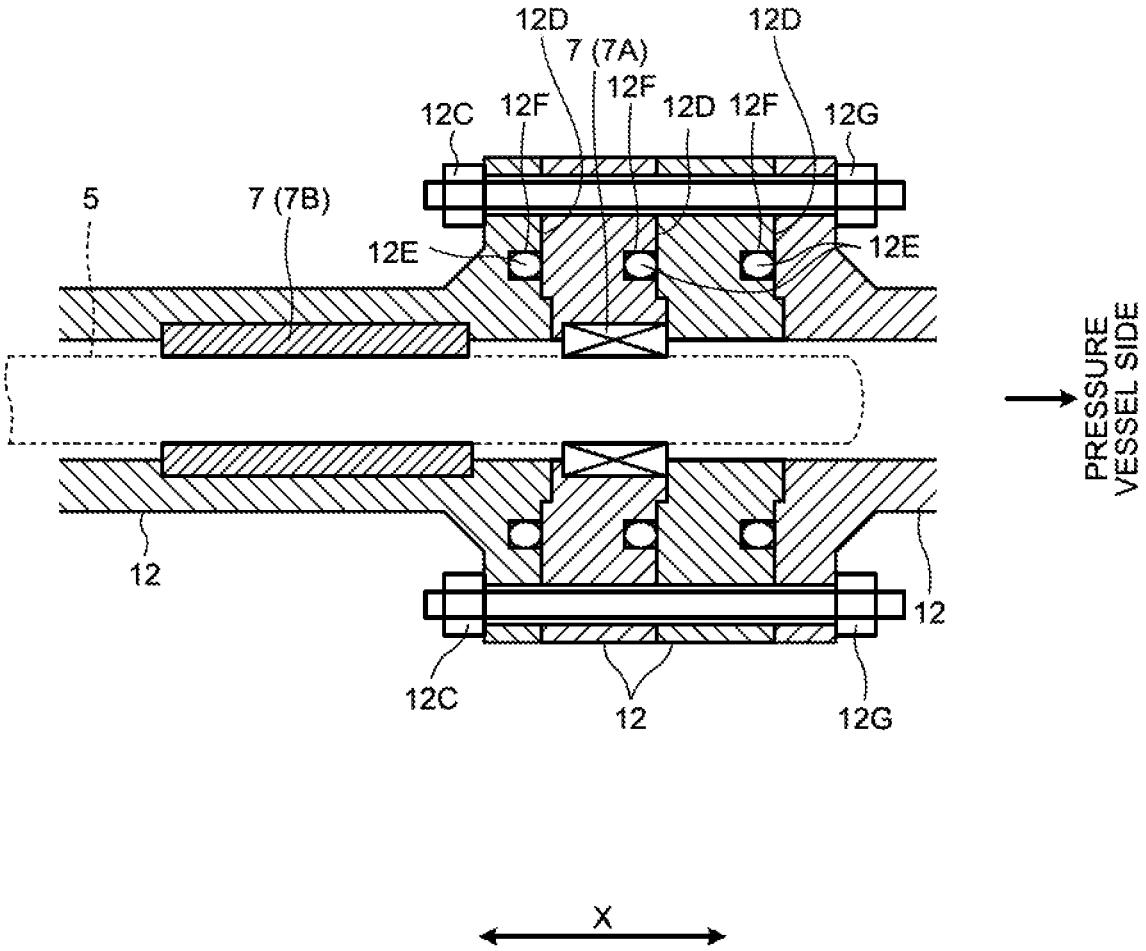
FIG. 7 is an essential-part enlarged view of still another example of the soot blower according to the embodiment of the present invention.

FIG. 6 and FIG. 7 are essential-part enlarged views of still other examples of the soot blower according to the present embodiment.

As illustrated in FIG. 6, in the soot blower of the present embodiment, the casing 1 has the divided casings 12 formed in a divided manner into a plurality of parts (four parts in FIG. 6) in a moving direction X of the injection pipe 5. The divided casings 12 form therein respective contact surfaces 12D that face each other in the moving direction of the injection pipe 5, the contact surfaces 12D being brought into contact with each other, and a recessed portion 12F is formed in one of the contact surfaces 12D that face each other in such a manner that the recessed portion 12F is formed in an annular shape in a circumferential direction, the recessed portion 12F housing a seal ring 12E. Furthermore, the divided casings 12 are fastened to each other with bolts 12G in the moving direction X of the injection pipe 5.

Consequently, the contact between the contact surfaces 12D that face each other is maintained, and the seal ring 12E housed in the recessed portion 12F formed in one of the contact surfaces 12D facing each other is brought into contact with the other contact surface 12D, thus ensuring airtightness. The support part 7 is arranged in the divided casing 12, and the nozzle 32*a* of the first gas supplying device 30 is arranged in the divided casing 12.

To be more specific, one of the divided casings 12 has the bearing 7A and the sealing material 7B of the support part 7, and the other of the divided casings 12 has the bearing 7A and the sealing material 7B of the support part 7 and the nozzles 32*a* of the first gas supplying device 30.

Here, in the configuration illustrated in FIG. 6, although the corresponding nozzles 32*a* of the first gas supplying device 30 are arranged on the pressure vessel 100 side and the sealing material-7B side of the bearing 7A, the present invention is not limited to this example. The nozzle 32*a* may be arranged on at least one of the pressure vessel 100 side and the sealing material-7B side of the bearing 7A. Furthermore, in the configuration illustrated in FIG. 6, the support part 7 is formed of the bearing 7A and the sealing material 7B that are separated from each other. However, when the support part 7 is formed into one piece so that the support part 7 can guide the movement of the injection pipe 5 and ensure the airtightness between the casing 1 and the injection pipe 5, the nozzle 32*a* may be arranged on at least one of the distal end side and the rear end side of the support part 7 formed into one piece.

With this soot blower constituted in this manner, for example, as the above-mentioned configuration illustrated in FIG. 2 to FIG. 4, when the gasket (vortex gasket) 12B is arranged between the flanges 12A, a distance between the flanges 12A facing each other changes due to the crushing margin of the gasket 12B, and thus a difference between their faces causes the axial center misalignment of the injection pipe 5. When the axial center misalignment occurs in the injection pipe 5, there exists the possibility that the injection pipe 5 is brought into contact with the heat transfer tube.

With respect to such drawbacks, the configuration illustrated in FIG. 6 is such that the seal ring 12E is housed in the recessed portion 12F and hence, in the axial direction, which is the moving direction X of the injection pipe 5, the contact surfaces 12D are brought into contact with each other without sandwiching the seal ring 12E between the contact surfaces 12D of the respective divided casings 12, thus reducing the axial center misalignment, and ensuring the airtightness with the seal ring 12E.

Furthermore, in the soot blower of the present embodiment, as illustrated in FIG. 6, it is preferable to constitute the divided casings 12 so that at least one of the divided casings 12 can be used as a spacer in which the support part 7 is not arranged.

That is, when the support part 7 is detached at the time of maintenance, the divided casing 12 constituted as the spacer is removed, thus ensuring a work space, and easily performing a maintenance work.

Here, in the soot blower, for reducing the axial center misalignment of the injection pipe 5, or for acquiring the advantageous effect to perform the maintenance work easily, the first gas supplying device 30 is dispensable. Consequently, it may be possible to adopt the configuration in which the divided casings 12 illustrated in FIG. 7 are provided to the soot blower, and the nozzle 32*a* of the first gas supplying device 30 is not provided to the soot blower.

REFERENCE SIGNS LIST

1 Casing
2 Connecting pipe
3 Insertion stop valve
4 Seal box
5 Injection pipe
5*a* Nozzle
6 Gland packing
7 Support part
7A Bearing
7B Sealing material
12 Divided casings
12D Contact surface
12E Seal ring
12F Recessed portion
12G Bolt
21 Steam feeding device
22 Steam source
23 Steam line
24 Shutoff valve
25 Check valve
30 First gas supplying device
31 First nitrogen gas supply source
32 First nitrogen gas line
32*a* Nozzle
33 Shutoff valve
34 Flow meter
35 Regulating valve
36 Orifice
37 Check valve
38 Branch line
39 Shutoff valve
100 Pressure vessel

The invention claimed is:

1. A soot blower in which a heat transfer tube of a heat exchanger is arranged inside a pressure vessel, and gas for cleaning is injected toward the heat transfer tube from an injection pipe that is provided to be movable into and out of the pressure vessel, the soot blower comprising:

a cylindrical casing provided to surround an insertion hole on the pressure vessel side into which the injection pipe is inserted, and to extend outside the pressure vessel, the injection pipe being inserted into an inside of the casing; and a support part provided inside the casing to guide movement of the injection pipe and to ensure airtightness between the casing and the injection pipe, wherein the casing includes a connecting pipe that communicates with an inside of the pressure vessel and a seal box that is connected to a side, away from the pressure vessel, of the connecting pipe, airtightness between the injection pipe and the seal boxes on a rear end side and a distal end side of the seal box is ensured by a gland packing and the support part, and the soot blower comprises a gas supplying device arranged on the pressure vessel side of the support part in the seal box to cause the injection pipe projecting to the pressure vessel side to directly generate a jet stream so that deposit adhering to a surface of the injection pipe is blown off.

2. The soot blower according to claim 1, wherein the support part includes a bearing to guide the movement of the injection pipe, and a sealing material that ensures airtightness between the casing and the injection pipe so that the bearing is arranged closer to a distal end of the sealing material, and the gas supplying device is connected to a portion closer to the pressure vessel side than the bearing, and is connected between the sealing material and the bearing.

3. The soot blower according to claim 1, wherein the gas supplying device includes a discharge part configured to discharge gas to an outside of the casing.

4. The soot blower according to claim 1, wherein the casing includes, in the seal box, a plurality of divided casings formed in a divided manner into a plurality of parts in a moving direction of the injection pipe, the divided casings have respective contact surfaces formed thereon, the contact surfaces facing and being brought into contact with each other in the moving direction of the injection pipe, a recessed portion being formed in one of the contact surfaces facing each other in an annular shape in a circumferential direction, the recessed portion housing a seal ring that is brought into contact with the other contact surface, and in the divided casings, the support part and a nozzle of the gas supplying device are provided.

5. The soot blower according to claim 1, wherein the casing includes, in the seal box, a plurality of divided casings formed in a divided manner into a plurality of parts in a moving direction of the injection pipe, the divided casings have respective contact surfaces formed thereon, the contact surfaces facing and being brought into contact with each other in the moving direction of the injection pipe, a recessed portion being formed in one of the contact surfaces facing each other in an annular shape in a circumferential direction, the recessed portion housing a seal ring that is brought into contact with the other contact surface, and in the divided casings, the bearing and a sealing material of the support part and a nozzle of the gas supplying device are provided, the sealing material ensuring airtightness between the casing and the injection pipe.

6. The soot blower according to claim 4, wherein at least one of the divided casings is constituted as a spacer in which the support part is not provided.

7. A soot blower in which a heat transfer tube of a heat exchanger is arranged inside a pressure vessel, and gas for cleaning is injected toward the heat transfer tube from an injection pipe that is provided to be movable into and out of the pressure vessel, the soot blower comprising:

a cylindrical casing provided to surround an insertion hole on the pressure vessel side into which the injection pipe is inserted, and to extend outside the pressure vessel, the injection pipe being inserted into an inside of the casing; and a support part provided inside the casing to guide movement of the injection pipe and to ensure airtightness between the casing and the injection pipe, wherein the casing includes a connecting pipe that communicates with an inside of the pressure vessel and a seal box that is connected to a side, away from the pressure vessel, of the connecting pipe, airtightness between the injection pipe and the seal boxes on a rear end side and a distal end side of the seal box is ensured by a gland packing and the support part, and the soot blower comprises a first gas supplying device arranged inside the seal box between the ground packing and the support part to cause the injection pipe to generate a jet stream so that deposit adhering to a surface of the injection pipe is blown off; and a second gas supplying device arranged inside the seal box between the ground packing and the support part to supply gas with a pressure higher than a gas pressure inside the pressure vessel, wherein the first gas supplying device supplies gas with a pressure higher than the pressure of the gas supplied by the second gas supplying device.

8. The soot blower according to claim 5, wherein at least one of the divided casings is constituted as a spacer in which the support part is not provided.

* * * * *